United States Patent [19]

Kishi

[11] Patent Number: 4,990,962

[45] Date of Patent: Feb. 5, 1991

[54] WET TYPE DEVELOPING DEVICE PROVIDING CONTROLLED AMOUNT OF DEVELOPING LIQUID

[75] Inventor: Motoshi Kishi, Suzuka, Japan

[73] Assignee: Brother Kogyo Kabushiki Kaisha, Japan

[21] Appl. No.: 488,959

[22] Filed: Mar. 5, 1990

[30] Foreign Application Priority Data

Apr. 11, 1989 [JP] Japan ..... 1-42900[U]
Aug. 31, 1989 [JP] Japan ..... 1-102551[U]

[51] Int. Cl.[5] ..... G03G 15/10

[52] U.S. Cl. ..... 355/256; 118/659; 118/661; 355/259

[58] Field of Search ..... 355/256, 259; 354/318, 354/317; 118/659, 661; 401/218; 427/14.1

[56] References Cited

U.S. PATENT DOCUMENTS 3,321,795 5/1967 Richardson ..... 401/218 X
3,902,800 9/1975 Anderson ..... 355/259
4,205,622 6/1980 Miyake et al. ..... 355/256 X
4,410,260 10/1983 Kuehnle ..... 355/256

*Primary Examiner*—A. T. Grimley
*Assistant Examiner*—Thu Anh Dang
*Attorney, Agent, or Firm*—Oliff & Berridge

[57] ABSTRACT

A wet type image developing device for applying a developing liquid over an electrostatic latent image provided on a photosensitive member on a rotary drum. The developing device has an inner tubular member and an outer tubular member. The developing liquid is pressurizingly supplied into the inner tubular member, and the outer tubular member is radially outwardly expandable by the liquid introduction for providing a facial contact of the outer tubular member with the photosensitive member. The developing liquid is transuded into the outer tubular member and is oozed out for applying the liquid over the photosensitive member. If no liquid is supplied to the inner tubular member, the outer tubular member is radially inwardly shrunken for the separation of the outer tubular member from the photosensitive member.

7 Claims, 3 Drawing Sheets

WET TYPE DEVELOPING DEVICE PROVIDING CONTROLLED AMOUNT OF DEVELOPING LIQUID

BACKGROUND OF THE INVENTION

The present invention relates to a wet type image developing device for use in an electrophotographic printer.

In a conventional electrophotographic printer, because of the utilization of a photo-conductivities, an electrostatic latent image is formed in accordance with an image information on a photosensitive member such as a photosensitive drum. The latent image is visualized by the adhesion of a coloring particles such as toners, and the toner image undergoes development. Here, known is a dry type developing method in which dry toner powders are used. Also known is a wet type developing method in which the toner powders are dispersed in an insulative liquid. In the latter method, dipping method, dripping method, injection method and contact method are available for forming the toners onto the photosensitive member.

According to a conventional contact type method in the wet type image developing mode, a developing roller formed of a sponge is used. During rotation of the sponge roller, a lower part of the roller is dipped in the developing liquid, whereas an upper part thereof is in rolling contact with the electrostatic latent image surface of the photosensitive drum. The developing liquid is absorbed into the sponge roller at its lower part, and the thus absorbed developing liquid is spread over the latent image surface.

In the above described contact type developing method, however, sufficient amount of developing liquid cannot be absorbed into the developer roller at its lower part due to the shortage in mass of the sponge. Further, since the developing liquid is absorbed into the roller while rotating the latter, sufficient amount of the developing liquid may not be transferred or supplied to the electrostatic latent image on the photosensitive drum. Accordingly, insufficient developing operation results, to thereby degrade a quality of a visible image.

Further, in the conventional contact type developing method, the developing roller is in always pressure contact with the photosensitive member an.d its retaining means, i.e, a photosensitive drum. Therefore, the developing roller and/or a unit for supporting the developing roller must be moved away from the photosensitive member and its retaining means, otherwise it becomes impossible to positively displace the developer roller, effect cleaning to the roller and to replace the roller by a new roller. To this effect, a special mechanism is required for moving the developing roller toward and away from the photosensitive member and the retaining means such as the photosensitive drum, which in turn, renders the overall device bulky and intricate.

SUMMARY OF THE INVENTION

It is therefore, an object of the present invention to overcome the above-described drawbacks and disadvantages and to provide an improved wet type image developing device.

Another object of the invention is to provide such wet type image developing device having simple construction and capable of supplying sufficient amount of a developing liquid to an electrostatic latent image surface on a photosensitive member, to thereby produce a high grade visible image.

These and other objects of the invention will be attained by providing a wet type image developing device including a developing roller for supplying a developing liquid to an electrostatic latent image surface on a photosensitive member secured on a rotary drum, the device comprising the developing roller having an inner tubular member defining therein an internal space, and an outer tubular member disposed over the inner tubular member. The developing liquid is pressurizingly introduced into the internal space, and the outer tubular member is expandable radially outwardly upon introduction of the developing liquid into the internal space to provide surface pressure contact of the outer tubular member with the photosensitive member. The developing liquid is transudeable from the outer tubular member radially outwardly to supply the liquid over the latent image surface. The outer tubular member is shrinkable radially inwardly upon suspension of the liquid supply to provide separation of the outer tubular member from the photosensitive member.

In another aspect of the invention, there is provided a multiple color developing apparatus in a wet type mode which uses a rotary drum and a photosensitive member retained on the rotary drum, the photosensitive member carrying thereon an electrostatic latent image, the apparatus comprising a plurality of developing devices having construction identical to one another and using developing liquids different from one another, the plurality of developing devices being movable in a direction with respect to the rotary drum, each of the developing devices comprising a developing roller having an inner tubular member defining therein an internal space, and an outer tubular member disposed over the inner tubular member, one of the developing liquids being pressurizingly introduced into the internal space, and the outer tubular member being expandable radially outwardly upon introduction of the developing liquid into the internal space to provide surface pressure contact of the outer tubular member with the photosensitive member, the liquid being transudeable from the outer tubular member radially outwardly to supply the liquid over the latent image surface, the outer tubular member being shrinkable radially inwardly upon suspension of the liquid supply to provide separation of the outer tubular member from the photosensitive member, various kinds of developing liquids being selectively supplied onto the electrostatic latent image surface of the photosensitive member in accordance with the movement of the plurality of developing devices.

The developing roller is normally out of contact with the photosensitive member. However, for the developing operation, when the developing liquid is introduced into the inner tubular member under pressure, the outer tubular member is expanded radially outwardly, so that it comes into contact with the photosensitive member. Further, the developing liquid introduced into the inner tubular member is oozed out through the plurality of holes and through the outer tubular member. Therefore, the developing liquid can be successively applied onto the photosensitive member in accordance with the rotation of the rotary drum. In this case, at least the outer tubular member is also rotated. If the developer liquid supply into the inner tubular member is suspended, the outer tubular member is shrunken radially inwardly, so that it is separated from the photosensitive member or the rotary drum. Therefore, the developing unit can be horizontally movable without any special mechanism for moving the roller toward and away from the rotary drum. If a plurality of developing devices having constructions identical to one another are prepared, and if various kinds of developing liquids are used, color copying is promptly carried out by the repeated expansion and contraction of the outer tubular members and horizontal displacements of the devices.

DETAILED DESCRIPTION OF THE PREFERRED EMBODIMENTS

Figure 1:
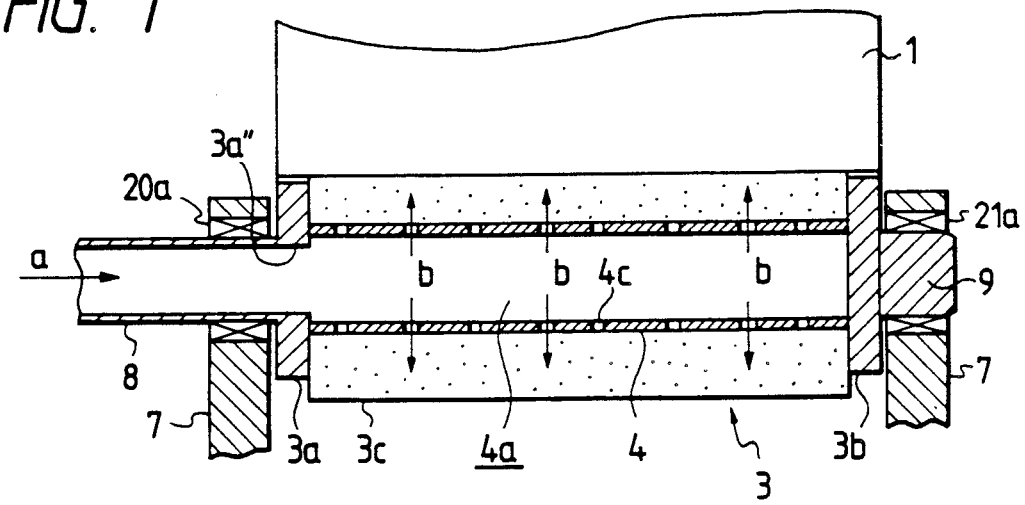
FIG. 1 is a schematic front cross-sectional view showing a wet type image developing device according to a first embodiment of this invention.

A wet type image developing device according to a first embodiment of this invention will be described with reference to FIGS. 1 thru 4. Similar to the conventional arrangement, a developing roller 3 is positioned in confrontation with a rotary drum 1 which retains a photosensitive member 2. The developing roller 3 is of a transude roller having an inner rigid tubular member 4 and an outer transude hollow cylindrical member or an outer tubular member 3*c*. The inner tubular member 4 has a hollow cylindrical space 4*a* in which a developing liquid can be accumulated. The inner tubular member 4 is formed with a plurality of minute holes 4*c* so as to permit the developer liquid accumulated in the hollow space or the accumulation chamber 4*a* to pass therethrough.

Figure 2:
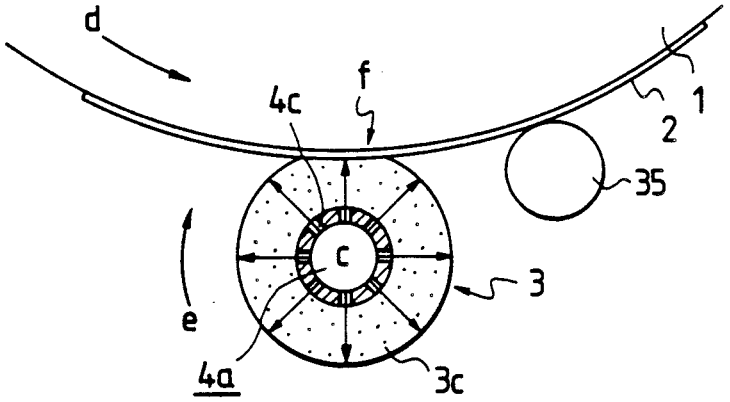
FIG. 2 is a schematic side cross-sectional view showing the wet type image developing device according to the first embodiment.
Figure 3:
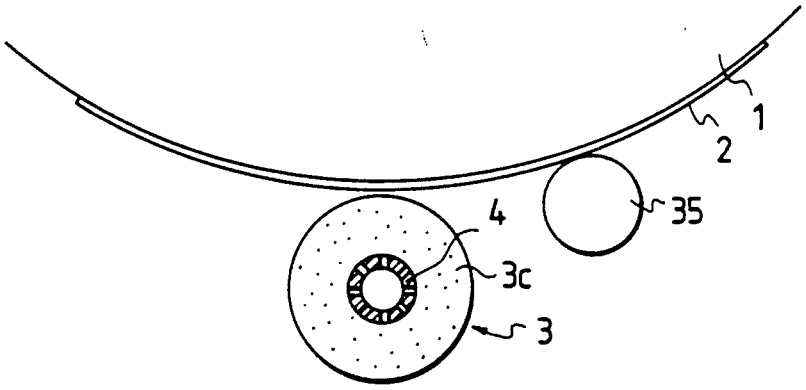
FIG. 3 is a schematic side cross-sectional view showing the wet type image developing device in its rest position according to the first embodiment.

The outer tubular member 3*c* is disposed over the inner tubular member 4. The outer tubular member 3*c* is formed of transudeable material such as a sponge, so that the developer liquid in the chamber 4*a* can ooze out radially outwardly. Further, the outer tubular member 3*c* is swollen radially outwardly when the liquid is pressurizingly introduced into the chamber 4*a*. In other words, in case the developer liquid is introduced into the inner tubular member 4, the outer tubular member 3*c* is swollen or expandable radially outwardly, so that the member 4 can maintain a surface (pressure) contact with the photosensitive member 2 as best shown in FIG. 2. On the other hand, if no developer liquid is introduced, the outer tubular member 3*c* is shrunken radially inwardly, so that it becomes separated from the photosensitive member 2 as best shown in FIG. 3.

At distal ends of the outer tubular member 3*c*. disc plates 3*a* and 3*b* are provided. The disc members 3*a* and 3*b* may be provided integral with the inner tubular member 4. One of the disc plates 3*b* is of complete circular shape so as to close one open end of the inner tubular member 4, whereas another disc plate 3*a* is formed with a central hole so as to provide a developer liquid inlet 3*a*41. An inlet tube 8 is integrally connected to the other disc plate 3*a* so as to deliver the developing liquid into the liquid accumulation chamber 4*a* through the inlet opening 3*a*″ in a direction indicated by an arrow (a). The inlet tube 8 also serve as a support shaft which is journalled by a bearing 20*a* to a roller support frame 7. The disc plate 3*b* is integrally provided with a support shaft 9 which is journalled through a bearing 21*a* to the frame 7. Therefore, the developing roller 3 is rotatable about its axis defined by axes of the inlet tube 8 and the support shaft 9.

Figure 4:
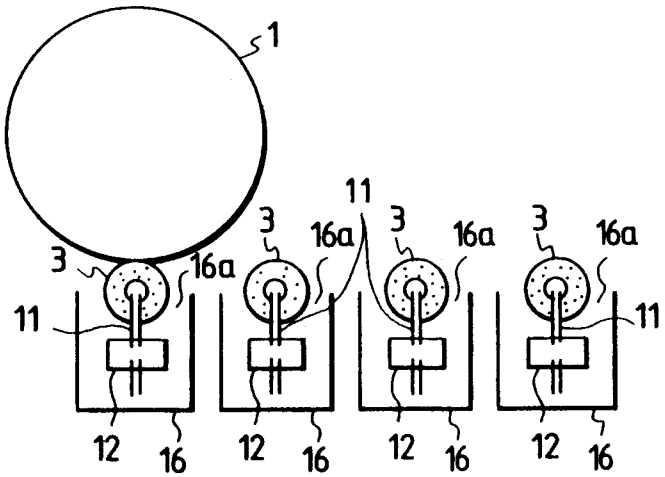
FIG. 4 is a schematic side view showing an overall arrangement of the wet type image developing device according to the first embodiment of this invention.
Figure 5:
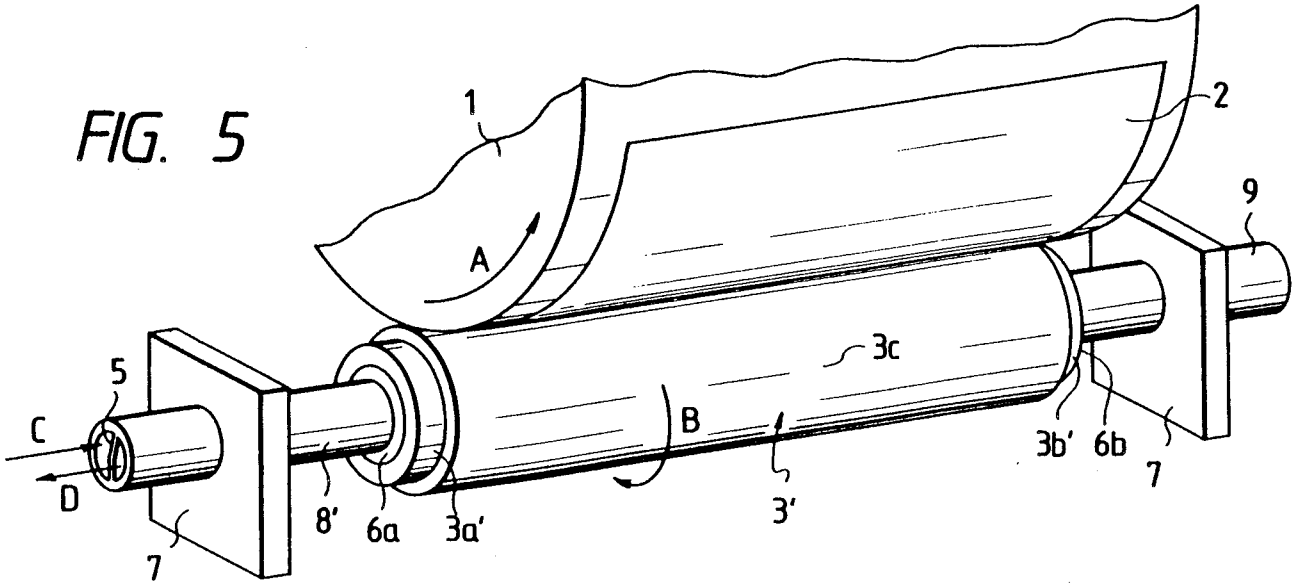
FIG. 5 is a perspective view showing a wet type image developing device according to a second embodiment of this invention.

As shown in FIG. 4, one end portion of the inlet tube 8 is connected to a supply hose 11 through a rotary joint(not shown). The supply hose 11 is connected to a pump 12 positioned in a developer liquid tank 16. The pump 12 intakes the developing liquid and pressurizingly supply the pumped liquid into the developer liquid accumulation chamber 4*a* of the inner tubular member 4. As shown in FIG. 4, the tank 16 has an open upper end. The developing roller 3 is also positioned within the tank 16 while an upper end of the roller 3 is positioned slightly above the open end.

At a position downstream the developing roller 3 as viewed in a rotational direction (d in FIG. 2) of the drum 1, a squeezing roller 35 is provided so as to remove surplus developer liquid transferred onto the photosensitive member 2 or the drum 1.

For the wet mode developing operation, the developing liquid in the tank 16 is pressurizingly delivered into the liquid accumulation chamber 4*a* through the hose 11, the inlet tube 8 and the inlet opening 3*a*′ in the direction (a). Therefore, internal pressure within the accumulation chamber 4*a* is increased, so that the outer tubular member 3*c* is expanded radially outwardly. As a result, the outer tubular member 3*c* is brought into contact with the photosensitive member 2 on the rotary drum 1 as shown in FIG. 2. Further, since the pressurized developer liquid is accumulated in the accumulation chamber 4*a* of the inner tubular member 4. and as a result, the liquid passes through the minute holes 4*c* and is transuded into the outer tubular member 3*c* in a direction indicated by an arrow (b) in FIG. 1, and accordingly, the outer tubular member 3*c* is swollen and the developing liquid oozes out of the outer peripheral surface of the outer tubular member 3*c*. Therefore, the photosensitive member 1 can be applied with the developing liquid at a contact line f (FIG. 2).

In accordance with a rotation of the rotary drum 1 in the direction (d), the developing roller 3 is also rotated in a direction indicated by an arrow (e) with maintaining the contact line f. Therefore, entire latent image area of the photosensitive member 2 is applied with the developing liquid. However, surplus developing liquid deposited on the latent image area is removed by the squeezing roller 35 to thus complete one cycle of the developing operation.

On the other hand, during non-service period of the device, the pump 12 is not operated and therefore, the developing liquid is not delivered to the accumulation chamber 4a. Accordingly, inner pressure in the chamber is lowered, so that the outer tubular member 3c is shrunken radially inwardly. Consequently, the outer tubular member 3c becomes out of contact with the photosensitive member 1 as shown in FIG. 3. Further, the developing liquid is not transuded outwardly. Therefore, in the non-service state of the device, the developing roller 3 can be freely moved without any additional mechanism for separating the roller 3 from the photosensitive member 2. In this connection, in the first embodiment of this invention, a plurality of developing devices can be provided juxtaposedly and movably in horizontal direction as shown in FIG. 4, and various color developing liquids can be accumulated in the respective tanks 16. With such arrangements, color copying can be achieved by simply moving the developing devices relative to the rotary drum 1 with selective contact and out of contact of the developing rollers with respect to the photosensitive member 2. Therefore, efficient color copying is achievable.

In view of the foregoing, according to the first embodiment, sufficient amount of the developing liquid can be provided onto the photosensitive member by introducing the developing liquid under pressure into the inner tubular member of the developing roller and by oozing out the liquid from the outer tubular member, and therefore, high grade visible image is provided with stabilized fashion at any time of developing operation. Further, since the outer tubular member is shrinkable radially inwardly during nonservice state, no special mechanism is required for moving the roller toward and away from the photosensitive member or the rotary drum. Accordingly, compact developing device is provided at low cost.

A wet type image developing device according to a second embodiment of this invention will next be described with reference to FIGS. 5 thru 8. In the second embodiment, improvement has been made on the first embodiment in terms of collection of surplus liquid supplied onto the photosensitive member or the rotary drum. That is, in the first embodiment, the squeezing roller 35 is additionally provided for this purpose. However, in the second embodiment, the squeezing roller can be dispensed with by an improved recirculation of the developing liquid.

In FIGS. 5 thru 8, like parts and components are designated by the same reference numerals and characters as those shown in the first embodiment to avoid duplicating description. In the first embodiment, the inner and outer tubular members are rotated together, and further, the inlet tube 8 and the support shaft 9 are rotatably supported by the frames 7. On the other hand, in the second embodiment, an inner tubular member 4' an external tube 8' and a support shaft 9 are not rotatable but is fixed to the frame 7. On the other hand, the outer tubular member 3c and side disc members 3a' and 3b' are rotatable relative to the inner tubular member 4'.

Figure 6:
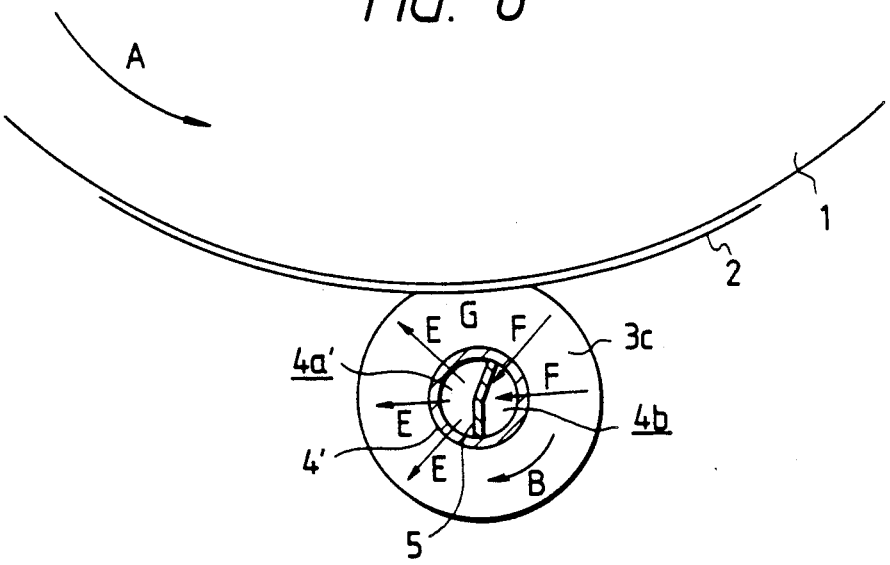
FIG. 6 is a schematic side cross-sectional view showing the wet type image developing device according to the second embodiment.
Figure 7:
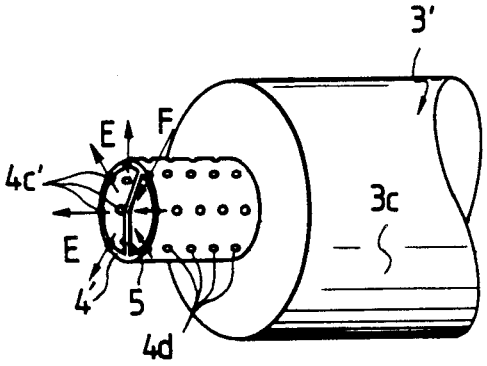
FIG. 7 is a partial perspective view showing an essential portion in the second embodiment.
Figure 8:
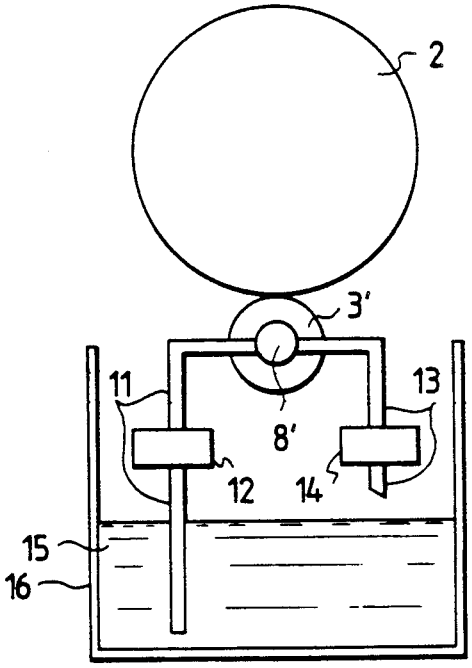
FIG. 8 is a schematic side elevational view showing an overall arrangement of the wet type image developing device according to the second embodiment of this invention.

More specifically, in the stationary inner tubular member 4', a partitioning plate 5 extends to devide the internal space into a developing liquid accumulating chamber 4a' and a developing liquid sucking chamber 4b as best shown in FIG. 6. Therefore, the tubular wall of the inner tubular member 4' is formed with a plurality of liquid supplying holes 4c' and a plurality of liquid sucking holes 4d. Disc plates 3a' and 3b' are provided similar to the first embodiment. However, one of the disc plates 3a' is provided rotatable about an external tubular member 8' (corresponding to the liquid inlet tube 8 of the first embodiment) through a bearing 6a. Further, the other disc plate 3b' is also formed with a central opening through which a support shaft 9' extends. The other disc plate 3b' is rotatable about the support shaft 9' through a bearing 6b. The external tube 8', the inner tubular member 4' and the support shaft 9' are provided integral with each other. Therefore, the outer tubular member 3c and the disc plates 3a' and 3b' are rotatable relative to the inner tubular member 4'.

The partitioning plate 5 also extends through the interior of the external tube 8'. A liquid supplying hose 11 is connected to one chamber of the external tube 8', and liquid discharge hose 13 is connected to another chamber of the tube 8'. Further, a liquid supply pump 12 is connected to the hose 11 for supplying the developing liquid 15 in a tank 16 into the developing liquid accumulation chamber 4a'in the inner tubular member 4'. And a liquid discharge pump 14 is connected to the hose 13 for sucking the liquid in the sucking chamber 4b and discharging the liquid into the tank 16.

Operation will be described. For the developing operation, developing liquid 15 in the tank 16 is pressurizingly delivered into the accumulation chamber 4a' through the hose 11, the pump 12, and the external tube 8' as shown by an arrow C in FIG. 5. When the liquid is filled in the chamber 4a' and the fluid pressure reaches a predetermined level, the liquid is transuded radially outwardly toward the outer tubular member 3c through the liquid supply holes 4c' as shown by an arrow E in FIG. 6. Therefore, outer peripheral portion of the outer tubular member 3c becomes wetted. In accordance with the rotation of the rotary drum 1, the outer tubular member 3c is rotated in a direction shown by an arrow B while the inner tubular member 4' stationary supported. Therefore, the latent image section can be successively applied with the developer liquid by an contacting area G.

In the developing operation, toner free developing agent solvent or surplus developing liquid may be coated. However, these liquid can be sucked into the sucking chamber 4b since a negative pressure is provided in the chamber by the pump 14. Therefore, such surplus liquid is again introduced into the outer tubular member 3c in a direction F and entered into the sucking chamber 4b through the sucking holes 4d, and are circulated into the tank 16 through the external tube 8' and the hose 13.

Therefore, in the second embodiment, the squeezing roller 35 can be dispensed with, and accordingly, spacial problem for installation of the roller 35 can be overcome.

While the invention has been described in detail and with reference to specific embodiments thereof, it would be apparent to those skilled in the art that various changes and modifications can be made therein without departing from the spirit and scope of the invention.

What is claimed is:

1. A wet type image developing device including a developing roller for supplying a developing liquid to an electrostatic latent image surface on a photosensitive member secured on a rotary drum, the device comprising;

the developing roller having an inner tubular member defining therein an internal space, and an outer tubular member disposed over the inner tubular member, the developing liquid being pressurizingly introduced into the internal space, and the outer tubular member being expandable radially outwardly upon introduction of the developing liquid into the internal space to provide surface pressure contact of the outer tubular member with the photosensitive member, the liquid being transudeable from the outer tubular member radially outwardly to supply the liquid over the latent image surface, the outer tubular member being shrinkable radially inwardly upon suspension of the liquid supply to provide separation of the outer tubular member from the photosensitive member.

2. The wet type image developing device as claimed in claim 1, wherein the inner tubular member is formed with a plurality of holes, and the device further comprising an external tubular member provided integral with the inner tubular member, and a developing liquid supply source connected to the external tubular member, the inner tubular member, the external tubular member and the outer tubular member being rotatable together in response to a rotation of the rotary drum.

3. The wet type image developing device as claimed in claim 2, further comprising a liquid removing means disposed downstream the developing roller with respect to a direction of the rotation of the rotary drum for removing a surplus liquid over the photosensitive member.

4. The wet type image developing device as claimed in claim 3, wherein the liquid removing means comprises a squeezing roller in rolling contact with the photosensitive member.

5. The wet type image developing device as claimed in claim 1, wherein the inner tubular member is formed with a plurality of liquid supply holes and liquid sucking holes;

and the device further comprising an external tubular member provided integral with the inner tubular member, a partitioning member extending in the external tubular member and the inner tubular member to divide the internal space into a developing liquid accumulation chamber and a liquid sucking chamber;

a developing liquid supplying means in fluid communication with the developing liquid accumulation chamber for supplying the developing liquid thereinto;

a liquid sucking means in fluid communication with the liquid sucking chamber for removing a liquid on the photosensitive member, the external tubular member and the inner tubular member being stationarily positioned and the outer tubular member being rotatable relative to the inner tubular member in response to the rotation of the rotary drum.

6. The wet type image developing device as claimed in claim 1 further comprising a liquid removing means for removing a surplus liquid over the photosensitive member, a part of the inner tubular member and a part of the outer tubular member being served as the liquid removing means.

7. A multiple color developing apparatus in a wet type mode which uses a rotary drum and a photosensitive member retained on the rotary drum, the photosensitive member carrying thereon an electrostatic latent image, the apparatus comprising a plurality of developing devices having construction identical to one another and using developing liquids different from one another, the plurality of developing devices being movable in a direction with respect to the rotary drum, each of the developing devices comprising a developing roller having an inner tubular member defining therein an internal space, and an outer tubular member disposed over the inner tubular member, one of the developing liquids being pressurizingly introduced into the internal space, and the outer tubular member being expandable radially outwardly upon introduction of the developing liquid into the internal space to provide surface pressure contact of the outer tubular member with the photosensitive member, the liquid being transudeable from the outer tubular member radially outwardly to supply the liquid over the latent image surface, the outer tubular member being shrinkable radially inwardly upon suspension of the liquid supply to provide separation of the outer tubular member from the photosensitive member, various kinds of developing liquids being selectively supplied onto the electrostatic latent image surface of the photosensitive member in accordance with the movement of the plurality of developing devices.

* * * * *